United States Patent [19]

Gassie

[11] Patent Number: 4,597,580

[45] Date of Patent: Jul. 1, 1986

[54] POISON DART

[76] Inventor: Jon M. Gassie, 316 Roosevelt St., Lafayette, La. 70501

[21] Appl. No.: 432,969

[22] Filed: Dec. 1, 1982

Related U.S. Application Data

[63] Continuation-in-part of Ser. No. 214,506, Dec. 8, 1980, abandoned.

[51] Int. Cl.[4] ..... F41B 15/00; A63B 65/02

[52] U.S. Cl. ..... 273/418; 102/512; 273/84 R

[58] Field of Search ..... 273/418–421, 273/84 R, 84 ES; 102/502, 512; 89/1.11; 43/6; 604/189, 130

[56] References Cited

U.S. PATENT DOCUMENTS

| | | | |
|---|---|---|---|
| 693,329 | 2/1902 | Neubauer | 102/512 |
| 2,796,691 | 6/1957 | Norris | 273/421 X |
| 2,995,373 | 8/1961 | Cox | 273/418 |
| 3,277,893 | 10/1966 | Clark | 273/418 X |
| 3,386,381 | 6/1968 | Ferb | 102/512 |
| 3,457,921 | 7/1969 | Waldeisen | 273/418 X |
| 3,502,025 | 3/1970 | Payne | 102/512 |
| 3,523,538 | 8/1970 | Shimizu | 89/1.11 X |
| 3,565,435 | 2/1971 | Bear | 273/418 |
| 3,616,758 | 11/1971 | Komorov | 102/512 |
| 3,754,509 | 8/1973 | Gogen | 102/502 X |
| 3,763,786 | 10/1973 | MacDonald | 102/512 |
| 3,771,249 | 11/1973 | Johnson et al. | 273/419 X |
| 3,820,465 | 6/1974 | Delphia | 102/512 |
| 3,885,562 | 5/1975 | Lampkin | 604/189 |
| 3,901,158 | 8/1975 | Ferb | 102/512 |
| 4,091,736 | 5/1978 | Mizelle | 102/502 |

FOREIGN PATENT DOCUMENTS

| | | | |
|---|---|---|---|
| 17323 | of 1914 | United Kingdom | 604/189 |
| 1198796 | 7/1970 | United Kingdom | 102/512 |

OTHER PUBLICATIONS

CAP-Chur Equipment Catalog 10-1966.

*Primary Examiner*—Paul E. Shapiro

[57] ABSTRACT

A poison dart for subduing a person having poison with effects that occur long enough after a person is struck by the dart to allow for treatment that prevents those effects. This makes a person struck by the dart likely to stop committing undesireable behavior and instead seek treatment. The dart has a readily identifiable substance, dispersible in the human body, to aid in identifying the poison and a substance, dispersible and relatively persistant in the human body, for indicating that a person has been struck by the dart within the past month. It is separable into a front part that carries the poison and becomes buried into flesh upon impact and a rear part which projects from the flesh and can be pulled free from the front part if it is pulled on. This helps ensure that the front part will remain in the flesh long enough for the poison to dissolve away from it. The dart does not cause rapid disablement and therefore is not useful for committing a crime like armed robbery.

8 Claims, 2 Drawing Figures

POISON DART

CROSS REFERENCE TO RELATED APPLICATION

This is a Continuation-in-Part Application. It in part discloses and claims subject matter disclosed and claimed in the Application, Ser. No. 214,506, filed on Dec. 8, 1980, now abandoned.

FIELD OF THE INVENTION

This invention relates to poison darts and particularly to poison darts suitable for use in the subdual of persons.

DISCUSSION OF PRIOR ART

Handguns have been popular for many years to deter attack and aid in the arrest of persons. Handguns can be very effective, but their associated hazards are a serious drawback to their ownership and use. Their purposeful and accidental firings cause much unintentional death and injury. In addition, they are often used for illegal purposes. For these reasons, many people would like handguns to be outlawed everywhere. Possession of handguns is already illegal in some places and their concealed possession is almost universally controlled.

Disabling sprays offer an advantage over handguns in being comparatively nonhazardous. But such sprays require good aim from a hard to aim device and have a very short range. Like handguns, sprays can also be used for illegal purposes. Some areas have outlawed their possession because of this.

The electrified dart gun is a recent development in the search for a safe substitute for handguns. It offers the advantage of causing little tissue damage in those struck by it. Its chief disadvantages are its complicated nature, inability to fire a great plurality of projectiles, cost, and its potential for illegal use.

SUMMARY OF THE INVENTION

The following words and their derivatives have the accompanying connotations in this application:

subdue: to deter from committing offensive behavior, and/or to encourage the surrender of, and/or to arrest, poison dart: dart comprising poisonous means and a payload dart, poisonous means for injuring: means for causing an unpleasant effect, abnormality, impairment, disablement, harm or the like, comprising one or more chemical substances such as poisons, toxins, potentiators, and synergists.

payload dart: any projectile with a relatively sharp piercing point, compared to a bullet, which is capable of carrying a payload of poisonous means, piercing the clothing, skin and flesh of a person while causing only slight wounding and delivering the payload into the flesh of the person. (Most of such payload darts are of two types, the automatic syringe type which delivers liquid payload by forcibly injecting it, and the solid type which passively delivers solid or viscous payload by allowing the dissolving and dispersing action of body fluids to separate the payload from the payload dart.)

deliver: to actively or passively put something in a place free and separate from the delivering means.

The main objects of this invention are to provide poison darts suitable for use in the subdual of a person, to provide method for using the darts and similar darts and to provide a projectile for internally marking a person.

The main advantage of the poison darts of this invention is that they can be used in the subdual of a person without killing, greatly injuring, nor disabling the person. The darts are potentially injurious but at the same time they are relatively safe compared to bullets. This safety is due to the facts that only a slight wound results from being struck by one of the darts, protective treatment exists against the injury or injuries caused by the darts' poisonous means for injuring a person, and there is enough time for a person struck by one of the darts to receive the treatment.

The injuries resulting from the darts can be selected for in manufacturing from a wide range, including slight temporary injury, severe temporary injury, slight permanent injury, severe permanent injury, and injury resulting in death. Probably the most effective and preferred dart for subdual has a poisonous means for injuring that would cause the death of a person struck by the dart if he did not receive protective treatment. In an ideal setting, the treatment can only be obtained by surrendering to a public agency such as a police force. In this setting, a criminal struck by this dart would almost certainly cease any criminal activity he might be comitting and voluntarily surrender to an agency that can insure that the treatment will be given, either by making arrangements with a third party for the treatment or by arrangto administer the treatment themselves.

Since the safety of the poison darts is important, the darts must possess a wide margin of safety with respect to the time period in which a person can receive effective preventive treatment after being struck. Accordingly, one object of this invention is to provide a potentially injurious, but relatively safe poison dart with delaying means that allows a person struck by the dart an extra amount of time to seek and receive protective treatment after being struck by the dart.

The main purpose of the darts of this invention is for aiding in the subdual of persons. It is important that this purpose be difficult to defeat. Defeating could occur if criminals somehow obtained drugs used for protective treatment against injuries caused by the darts. However, if the chemical nature of the poisonous means was not the same for all of the darts on the market and it was only easy for treatment administering agencies to know the chemical nature of those means, then possession of drugs for protective treatment would be of little value for treatment. Therefore, another object of this invention is to provide a potentially injurious but relatively safe poison dart with means for identifying the chemical nature of the injuring means.

Defeating of the poison darts purpose could also occur if a person struck by one of the darts interferes with the delivery of the payload. Accordingly, another object of this invention is to provide a payload dart which is difficult to defeat with respect to the delivery of its payload.

In the event that the purpose of one of the darts of this invention were defeated and the dart was also removed from the person's flesh, it would be valuable if some form of evidence existed in the person to mark the person as having been struck by the dart. This evidence could also prove valuable for use with any projectile designed to penetrate into a person's flesh. Therefore, another object of this invention is to provide a projectile with means for internally marking a person for at least two months, that can not be surgically removed.

An important advantage of the darts of this invention is that they are useless for most illegal purposes, e.g., armed robbery, hostage taking and other crimes of duress. This is because the darts do not rapidly disable and there is no threat of rapid death from them. And, if one of the darts were used impulsively against an innocent person, there would be time for for the victim to receive the protective treatment before he could be injured by the dart. There would also be little danger if a person were accidently struck by one of the darts. Thus, one would have little to fear in possessing the darts in his home. This is not the case with handguns.

Another advantage of the poison darts and the payload dart of this invention is that either can be used in combination with rapidly disabling agents like narcotics, paralysing drugs and pain producing substances to increase effectivity of purpose at only slight cost to safety. Such darts do have a potential for criminal use, however the darts can be identified with serial numbers that can be recorded along with the names of the purchasers. This would greatly insure against their illegal use.

Another advantage is that the darts of this invention do not require a launching or propelling apparatus. Since darts are only practical for short range use, the darts of this invention can be designed for throwing by hand. This would take up less space and weight than most other means for subdual, and without additional apparatus, costs would be less.

The darts of this invention can be used to accomplish many of the things that the cited prior art can, but they do not have the cited disadvantages. Further objects and advantages of this invention will become apparent from a concideration of the drawings and descriptions herein.

DESCRIPTION OF THE PREFERRED EMBODIMENTS

A payload dart with a solid payload is used herein for the preferred embodiments. However, there is no reason that the payload of the preferred embodiments cannot be modified for use with an automatic syringe type payload dart.

Figure 1:
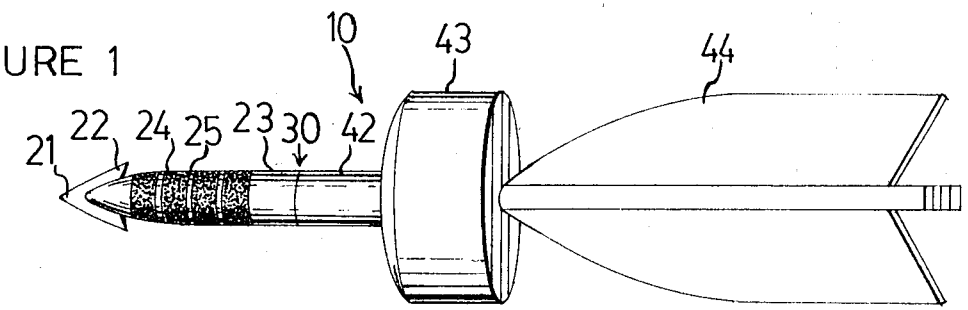
FIG. 1 is a larger than life-size perspective view of a poison dart according to this invention and its preferred embodiments.
Figure 2:
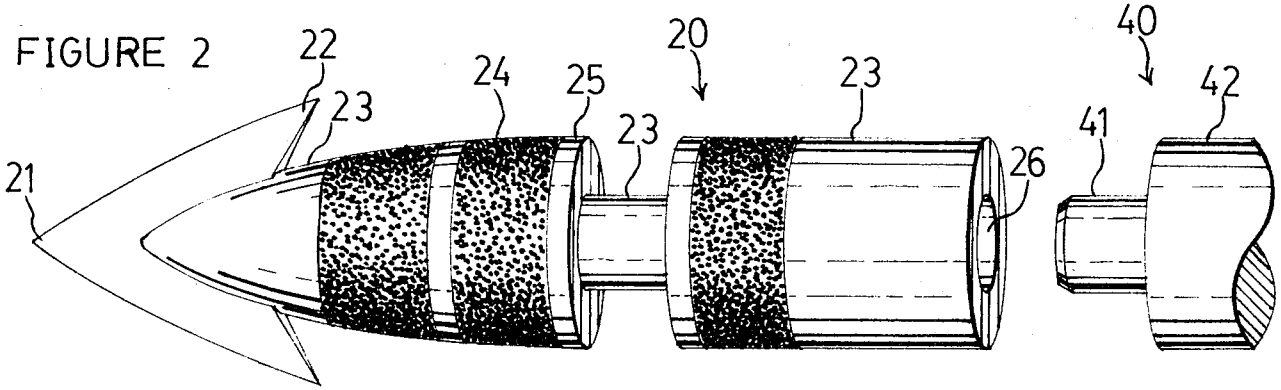
FIG. 2 is an enlarged fragmentary view of the dart, exploded and with a portion of one element omitted.

FIG. 1 of the drawings shows a poison dart 10 constructed according to this invention and its preferred embodiments. FIG. 2 shows that the dart consists of two parts.

The front part 20 comprises a sharp point 21, two barbs 22, a front shaft 23 of variable diameter, and a payload 24 which is divided into four portions by three ribs 25. The rear of the front shaft 23 has a cylindrical hole in it which forms a female fitting 26. Except for the payload 24, the front part 20 is of metallic construction.

In FIG. 1, reference numeral 30 designates the joint between the front part 20 and the rear part 40.

FIG. 2 shows that the rear part 40 comprises a beveled male fitting 41 and a rear shaft 42. FIG. 1, shows that rear part 40 further comprises the dart's body 43 and four stabilizing fins 44, joined at their bases and with one and part of another fin shown edge on. The male fitting 41 and the rear shaft 42 are of a metallic construction.

The construction materials and dimensions of the payload dart according to the preferred embodiments of this invention are nonspecific to the extent that the dart must be strong, massive and aerodynamically stable enough to carry an effective amount of payload on a short range flight and then penetrate a moderate amount of clothing, bury itself sufficiently deep into flesh while causing only minor wounding and deliver the payload by remaining in the flesh long enough for the payload to dissolve free from the rest of the front part 20.

The preferred embodiments are designed to be projected into flight by a high pressure gas means operating in a tubular means which maintains a close fit with the cylindrical surface of the dart's body 43. During flight, the dart is stabilized by the stabilizing fins 44.

The dart's sharp point 21 assures easy penetration of clothing and flesh and causes only minor wounding.

After the dart strikes clothed or unclothed flesh, it enters the flesh until the relatively blunt front surface of the body 43 strikes clothing or flesh. The body 43 acts as a stop and the front part 20 of the dart comes to rest completely below skin level. Although the front part 20 is separable from the rear part 40, the relatively low mass of the front part 20 does not allow it to overcome friction and continue on its own after the relatively massive body 43 comes to rest. Thus, the dart does not penetrate deeply into flesh and cause unnecessary injury.

For ideal operation of the dart, it should penetrate into flesh with no closely underlying bone. More of the human body fits into that classification than does not, especially since the generally overweight condition of the population provides thicker flesh over bones.

After the dart comes to rest with the front part 20 buried into flesh, blood and other fluids quickly begin dissolving the payload 24 free from the payload dart, thus delivering the payload into flesh. However, if it were not for the barbs 22 and the dart's ability to separate into two parts, the payload 24 might not remain in the flesh long enough to completely dissolve free from the rest of the front part 20. This would occur with a one piece dart if it bounced out from impact with resiliant clothing and/or flesh or if a person pulled it out.

The front part 20 and the rear part 40 are held together by the fit of male fitting 41 with female fitting 26. The degree of fit is as tight as pratically possible, but loose enough so that the force required to disengage the fittings is less than the force required to pull the front part 20 free from human flesh due to the holding action of the barbs 22 and to a much lesser extent, friction. Thus, if sufficient rearward force, e.g., from bouncing or pulling, is applied with the dart buried into human flesh, the dart will separate into its two parts, leaving front part 20 completely buried below skin level where the payload will have time to completely dissolve free from the front part 20. This may necessitate minor surgery to remove the front part 20, however it should be borne in mind that overall, the embodiments of this invention are less hazardous than bullets.

In order to assure the same degree of fit at all temperatures and to prevent possible corrosive interaction, the female fitting 26 and the male fitting 41 are of the same metal. Male fitting 26 is beveled to aid in inserting it into female fitting 41.

The payload 24 is compressed into the spaces between the ribs 25. In FIG. 2 one portion of the payload 24 is not illustrated in order to show one of those spaces. The ribs 25 provide tooth and support to hold the payload 24 to the front part 20. In some embodiments of this invention the ribs 25 can also be used to isolate substances where a plurality of different substances are used in the payload 24 and detrimental chemical reactivity would occur if the substances were mixed.

The payload 24 of the first preferred embodiment consists of four portions of lactose and Evans blue matrix, each bearing a great plurality of granules. Each of the granules consists of a core of trypsin activated Clostridium botulinum type E toxin in a diluent of lactose surrounded by a coating of stearic acid.

When the payload 24 comes into contact with body fluids during operation, the lactose and Evans blue matrices quickly dissolve, freeing the granules into surrounding flesh. The lactose of the matrices serves to bind the payload 24 to the dart and the lactose has excellent dissolving properties.

There is a total of 50 mcg. of the toxin contained in the great plurality of granules. The toxin serves as a poisonous means for injuring a person. It will injure a person so greatly that if protective treatment is not given in time, the person will die.

The toxin is one of the most poisonous substances known. As with most of the deadly poisons, it is not presently known what its exact degree of lethality is for man. Data indicate that virtually no person could survive the specified dosage if untreated. A protective treatment of antitoxin exists and is effective if given before the toxin becomes bound to nervous tissues. Any person struck by this embodiment must receive the protective treatment or face almost certain death.

Presently the antitoxin is largely controlled by the U.S. Public Health Service. It is not found at ordinary drugstores or doctor's offices. Therefore, a person struck by this embodiment could not assault a pharmacist or M.D. and receive treatment. Widespread marketing of this embodiment would undoubtably be accompanied by widespread distribution of the antitoxin to agencies capable of administering the protective treatment.

It should be noted that a toxoid immunization against the toxin is possible. However, the toxin itself is not effective for immunization when used according to this invention. Therefore, a survivor of one of the darts containing the toxin will still be susceptable to the effects of the toxin in the future.

The stearic acid that forms the coating part of each granule serves as a means for delaying the injuring caused by the poisonous means for injuring a person. It accomplishes this by preventing the injuring means from rapidly dissolving in body fluids after it it is delivered into flesh. Stearic acid breaks down slowly in the human body and it is often used as a delayed release coating for various drugs, e.g., the delayed release granules in many cold capsules.

The thickness of the coating determines the amount of time it will take to break down and thus, the amount of delaying which will take place. In this preferred embodiment the stearic acid coating of each granule will delay the dissolving of the toxin in body fluids for about two hours. This serves to allow a person struck by the dart two hours more to receive the protective treatment.

The botulinum toxin of this embodiment acts slowly enough that the delaying means is not a necessity for providing a long enough time period for the surrender of a person to an agency empowered to arrrest him in preparation for the administration of protective treatment, for the other necessary steps prior to the protective treatment and for receiving the protective treatment. The delaying means provides a greater margin of safety here. But delaying means can also be used with rapid functioning injuring means to help provide a long enough time period for treatment.

The Evans blue in the payload 24 serves as means for more easily identifying the chemical nature of the poisonous injuring means. It weighs a total of 20 mg. and can be detected in a person's serum for more than two months after being struck by the dart.

In order to reduce the possibility of the dart's purpose being defeated, darts with any one of several different poisonous injuring means are placed on the market simultaneously. Further, each injuring means is accompanied by different identifying means. Under this system, the key to the identifying means is only given to agencies responsible for administering the protective treatment.

This embodiment has two different types of identifying means. One type based on a chemical, Evans blue, and one based on inscription.

Evans blue is a nontoxic chemical. It rapidly dissolves in body fluids and thereafter is easily detected by qualitative chemical analysis. Its detection is much easier and quicker than botulinum toxin.

The dart also has identifying means in the form of inscriptions. One on the front part 20 and the other on the rear part 40 of the dart.

Inscriptions of code numbers, letters or symbols are a faster way of identifying the chemical nature of the injuring means than is identifying means based on chemicals. But since it is possible that the inscriptions might in some way become lost, it is best for the projectile to also carry identifying means based on a chemical when the chemical nature of the injuring means cannot be rapidly detected. This is the case with the botulinum toxin.

The Evans blue of this embodiment also serves as means for internally marking a person. It will function for at least two months and cannot be completely removed by surgery. Thus, if a person somehow defeats the purpose of the dart or escapes from custody after receiving protective treatment, the presence of Evans blue in his serum for two months after being struck by the dart, would be evidence that he had indeed been struck.

Since delaying means are not always a necessity for helping to to provide a long enough time period for surrender and administration of protective treatment, another embodiment similar to the first preferred embodiment is included in this invention. This second embodiment is identical to the first preferred embodiment as drawn and described except that it does not include delaying means. It also operates identically to the first preferred embodiment except in those areas relating to the delaying means.

This invention also includes a third preferred embodiment consisting of the payload dart of the first and second preferred embodiments with a payload 24 of 20 mg. of Evans blue and lactose sufficient for binding the payload to the payload dart. This third preferred embodiment operates identically to the other two embodiments with respect to the payload dart and the delivery of the payload. The purpose of this third preferred embodiment is to internally mark a person and it does this just as the first preferred embodiment does.

It is intended and should be understood that the foregoing is merely illustrative of the principles of this invention and does not impose any limitations on this invention. Since numerous modifications may occur to those skilled in the art, it is intended and should be understood that no limitations are placed on this invention, except as set forth in the appended claims.

I claim:

1. A payload dart which comprises:

a front part which carries the payload and becomes completely buried into and anchored in flesh during the operation of said payload dart;

means, located on said front part, for anchoring said front part in said flesh;

a rear part which is joined to and is separable from said front part, said rear part remaining at least partly exposed during said operation and remaining joined with said front part during said operation unless, after said front part is completely buried and anchored, rearward force sufficient to cause separation is applied to said rear part; and means located on said front part and rear parts, for joining and allowing separation of said front and rear parts, said joining means joining said front and rear parts with a force less than the force required to pull said front part from its position after said front part has become anchored in said flesh.

2. A poison dart comprising:

poisonous means for injuring a person;

means in contact with said poisonous means for delaying the functioning of said poisonous means after said poisonous means has been delivered into the flesh of said person; and a payload dart for carrying and delivering said poisonous means and said delaying means into said flesh.

3. A poison dart as recited in claim 2 wherein said poisonous means comprises: poison that is lethal for said person.

4. A poison dart as recited in claim 2 further comprising:

means for facilitating the identification of said poisonous means, said identifying means having a nature which allows dispersal of said identifying means in the body of said person through bodily processes.

5. A poison dart as recited in claim 2 further comprising:

means for internally marking said person for at least one month, said marking means having a nature which allows dispersal of said marking means in the body of said person through bodily processes.

6. A method of subduing a person exhibiting undesireable behavior comprising the steps of:

(a) providing a poison dart with (1) poisonous means for injuring said person, and (2) means for delaying the functioning of said poisonous means after said poisonous means has been delivered into the flesh of said person; and (b) delivering said poisonous means and said delaying means into the flesh of said person by striking said person with said dart.

7. A method of subduing a person as recited in claim 6 further comprising:

(c) arresting said person.

8. A method of subduing a person as recited in claim 6 wherein said poisonous means is for fatally injuring said person.

* * * * *